US005242005A

United States Patent [19]

Borgardt

[11] Patent Number: 5,242,005

[45] Date of Patent: Sep. 7, 1993

[54] BREAKAWAY BI-FOLDING DOOR ASSEMBLY

[75] Inventor: Ronald Borgardt, Kenner, La.

[73] Assignee: Optima, Inc., Kenner, La.

[21] Appl. No.: 974,685

[22] Filed: Nov. 12, 1992

Related U.S. Application Data

[63] Continuation of Ser. No. 792,805, Nov. 15, 1991, abandoned.

[51] Int. Cl.[5] ..... E06B 3/48

[52] U.S. Cl. ..... 160/118; 160/210; 49/127

[58] Field of Search ..... 160/117, 118, 210, 203, 160/213, 199, 206, 335; 49/128, 127, 125, 104, 246, 247

[56] References Cited

U.S. PATENT DOCUMENTS

| | | | |
|---|---|---|---|
| 2,311,470 | 2/1943 | Ritter | 20/20 |
| 2,331,512 | 10/1943 | Siedschlag | 16/150 |
| 2,952,313 | 9/1960 | Stroup | 160/209 |
| 3,029,868 | 4/1962 | Ogburn et al. | 160/118 |
| 3,101,777 | 8/1963 | Sherron | 160/206 |
| 3,111,165 | 11/1963 | Nelson | 160/206 |
| 3,138,474 | 6/1964 | Reiss et al. | 160/206 |
| 3,229,751 | 1/1966 | Moorer | 160/185 |
| 3,233,277 | 2/1966 | Hirashiki | 16/168 |
| 3,297,077 | 1/1967 | Garbus | 160/231 |
| 3,359,594 | 12/1967 | Pastoor | 16/178 |
| 3,385,344 | 5/1968 | Andrews | 160/206 |
| 3,949,801 | 4/1976 | Sasaki | 160/229 R |
| 4,387,760 | 6/1983 | Greschbach | 160/229 R |
| 4,534,395 | 8/1985 | Carroll | 160/118 X |

*Primary Examiner*—Blair M. Johnson

*Attorney, Agent, or Firm*—Pravel, Hewitt, Kimball & Krieger

[57] ABSTRACT

A breakaway bi-folding door assembly, which would include a pair of bi-folding doors of the type having a first end hinged to an upper frame, and a second end travelling within a slot in the frame to allow the doors to fold and unfold between open and closed positions for defining an open or closed doorway through a passage. Furthermore, the assembly would include a movable plate member for each of the bi-folding doors, positioned on the frame, and hinged along one end for moving outward from the frame.

15 Claims, 6 Drawing Sheets

BREAKAWAY BI-FOLDING DOOR ASSEMBLY

This is a continuation of co-pending application Ser. No. 07/792,805 filed on Nov. 15, 1991, now abandoned.

BACKGROUND OF THE INVENTION

1. Field of the Invention

The apparatus of the present invention relates to bi-folding doors. More particularly, the present invention relates to a novel assembly of a bi-folding door which allows the bi-folding doors to be broken away from the frame and to swing open in the manner of a conventional door during emergency situations.

2. General Background

In general, bi-folding doors are very useful in many areas where there is insufficient space to allow a conventional door to be swung open on a normal basis. Therefore, when a bi-folding door is utilized because of the nature of the construction, the doors when open would provide in effect, one-half of the space against the adjacent wall that would be normally occupied by a conventional door. For examples, in hospitals where bi-folding doors are very useful, were one to use a conventional door at all times in a passageway, in the construction one would have to maintain sufficient space on the adjacent wall so as to allow the conventional doors to swing open. Such an inconvenience might not provide for the fact that one could place a doorway into a room at that position in view of the fact that a conventional door would swing open into the doorway. In order to avoid this situation, bi-folding doors are commonly utilized.

However, one of the shortcomings of bi-folding doors is the fact that during emergency situations, many, if not all, state fire codes require that doors have the ability to be swung open, as with a conventional door, simply upon manual force from a person in the hallway. This is often the case when patients must be rushed out of a hallway and one cannot wait for either the electric eye of the bi-folding door or one would have insufficient space to move through the passageway, since the bi-folding door, when folded, does occupy some space in the passageway. The present invention would accommodate this requirement in passageways such as hospitals or the like, where emergency situations require that any type of door have the capacity to be fully swung open when necessary.

There have been several patents granted in the art which address bi-folding or sliding doors, the most pertinent being as follows:

| PATENT NO. | INVENTOR | TITLE |
|---|---|---|
| 2,311,470 | Ritter | "Flexible Panel, Door, Or Closure" |
| 4,387,760 | Greschbach | "Sliding Folding Door" |
| 3,949,801 | Sasaki | "Device For Automatically Closing A Folding Door" |
| 3,385,344 | Andrews | "Bi-Fold Door Structure" |
| 3,359,594 | Pastoor | "Folding Closures" |
| 3,297,077 | Garbus | "Folding Door Structure" |
| 3,233,277 | Hirashiki | "Hinge" |
| 3,229,751 | Moorer | "Folding Door Structure" |
| 2,952,313 | Stroup | "Sectional Upwardly Acting Doors And Like Closures" |
| 2,331,512 | Siedschlag | "Hinge" |

Other objects of the invention will be obvious to those skilled in the art from the following description of the invention.

SUMMARY OF THE PRESENT INVENTION

The apparatus of the present invention solves the shortcomings in the art in a simple and straightforward manner. What is provided is a breakaway bi-folding door assembly, which would include at least a pair of bi-folding doors of the type having a first end hinged to an upper frame, and a second end travelling within a slot in the frame to allow the doors to fold and unfold between open and closed positions for defining an open or closed doorway through a passage. Furthermore, the assembly would include a movable plate member for each of the bi-folding doors, positioned on the frame, and hinged along one end for moving outward from the frame.

There is further provided a slot cut within the movable plate for engaging the travelling end of each of the bi-folding doors and a stationary plate positioned on the frame for defining a means to engage the movable plate member when the doors are operated as standard bi-folding doors and for further allowing the movable plate member to be disengaged from the frame and swung to the open position allowing the bi-folding doors to likewise be swung to the fully open position as with a conventional door.

Therefore, it is a principal object of the present invention to provide a bi-folding door assembly which has the feature to break away to a fully opened position, as with a conventional door;

It is a further principal object of the present invention to provide a bi-folding door assembly, which may be used as standard bi-folding door assembly yet in an emergency be swung to the fully open position when necessary;

It is still a further object of the present invention to provide a break away bi-folding door assembly, which would allow upon force by a person moving therethrough, to swing the bi-folding doors to a fully opened position, despite the position of the bi-folding doors between fully opened or fully closed positions; and It is still a further object of the present invention to provide a bi-folding door assembly which may be operated either manually or through powered means, yet when the need be, the bi-folding doors to be swung to the open position for allowing a greater egress through the passageway.

DETAILED DESCRIPTION OF THE PREFERRED EMBODIMENT

Figure 1B:
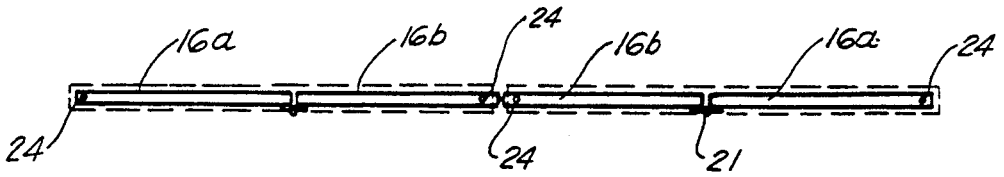
FIGS. 1A and 1B illustrate front and top views of a bi-folding door assembly in the fully closed position.

For a further understanding of the nature and objects of the present invention, reference should be had to the following detailed description taken in conjunction with the accompanying drawings, in which like parts are given like reference numerals, and wherein:

FIGS. 1 through 6 illustrate the preferred embodiment of the apparatus of the present invention by the numeral 10. As illustrated, the breakaway folding door apparatus 10 would generally comprise an upper frame means 12 extending across the opening of a doorway 14 as illustrated in FIG. 2A, of the type generally that would provide a wide doorway passage such as found in hospital corridors or the like. The folding door apparatus 10 would further comprise a plurality of door panels 16, in two pairs 18 and 20. The first pair 18 would include a pair of panels 16*a* and 16*b* hingedly connected along their edges 21 to one another so as to provide a continuous connection 22 as seen. Further, as seen in top view in FIG. 1B, the panels 16*a* would be connected to the upper frame 12 via a pair of pins 24, so that the doors are able to move from the closed position as seen in FIG. 1B to the open position as seen in FIG. 2B (arrows 25), so as to provide an opening 26 as seen in the FIGS. 2A and 2B. In general, this configuration would be typical of bi-folding doors, which are known in the art.

Figure 1A:
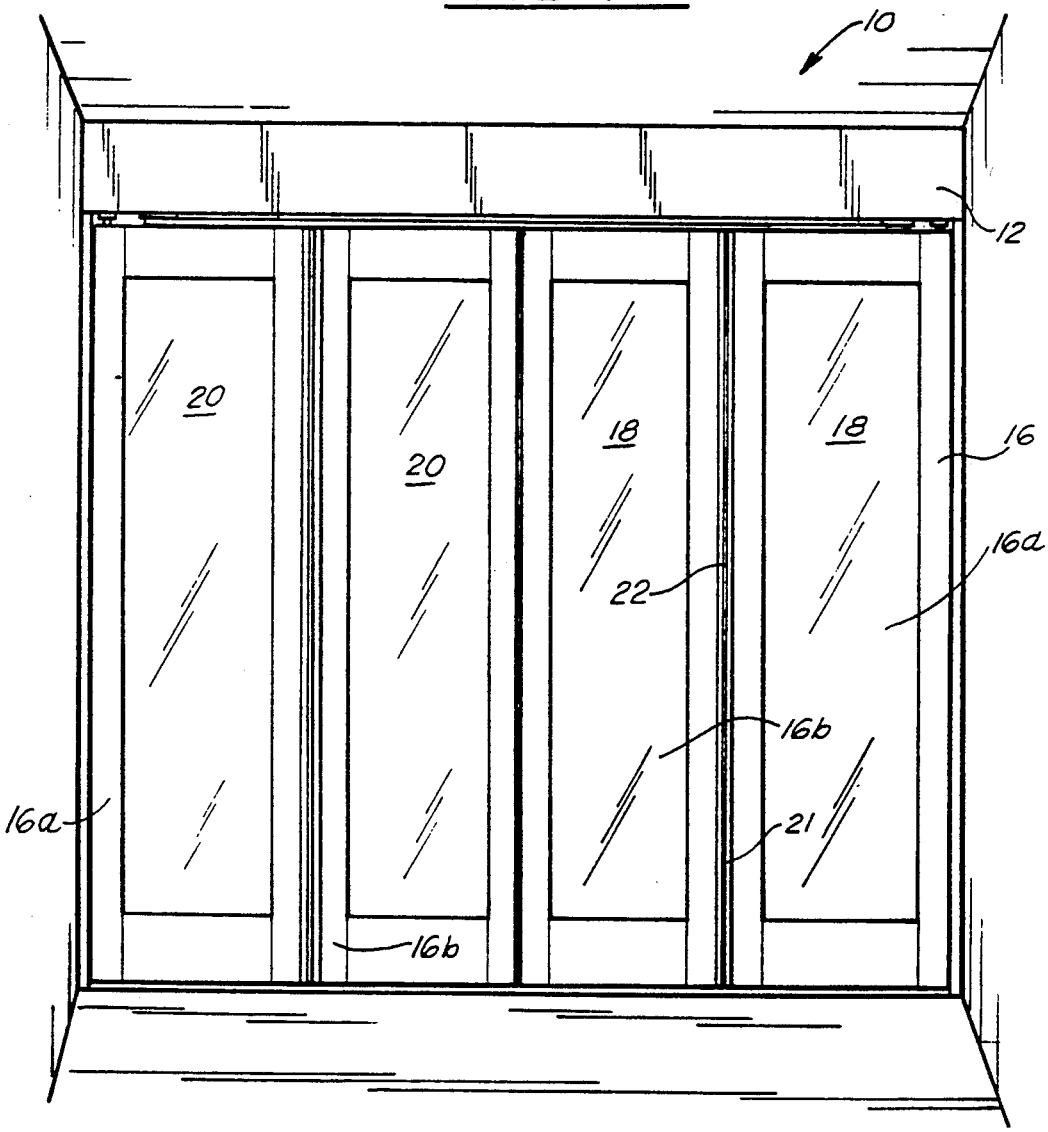
Figure 3A:
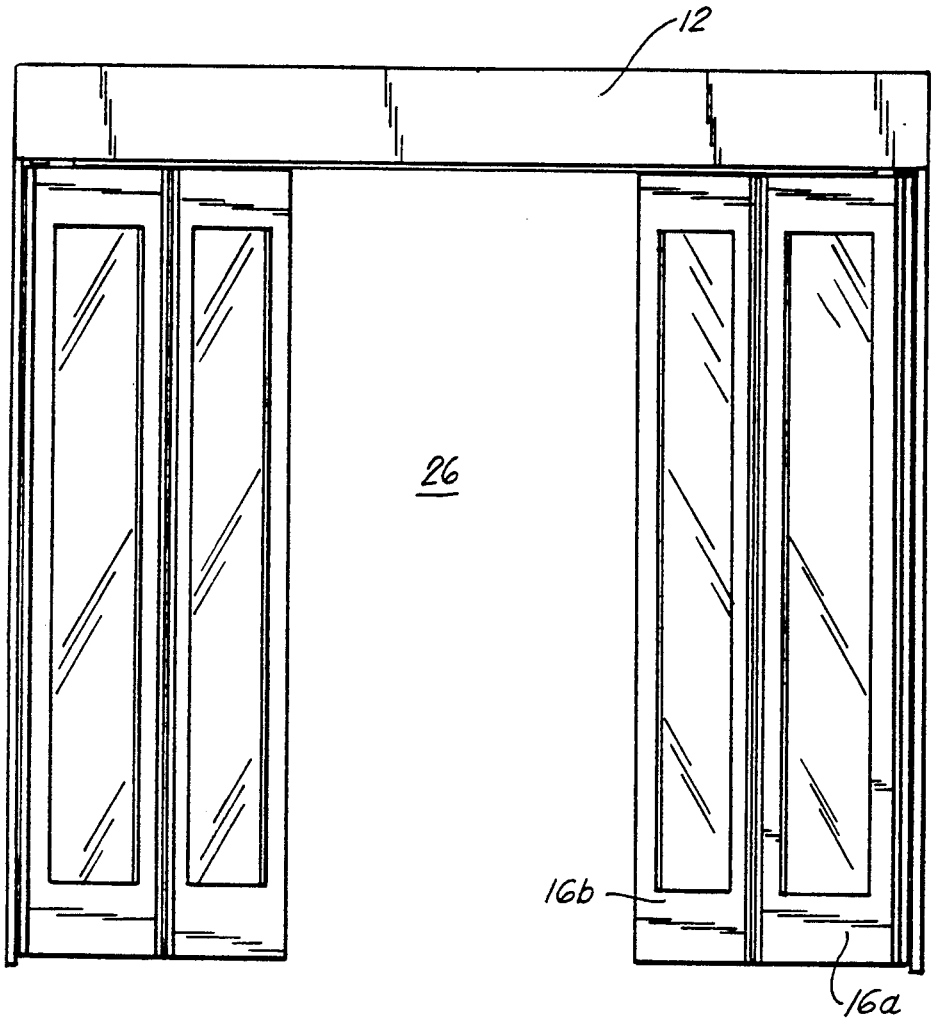
FIGS. 3A and 3B illustrate front and top views of the break away bi-folding door assembly in the preferred embodiment of the present invention.
Figure 3B:
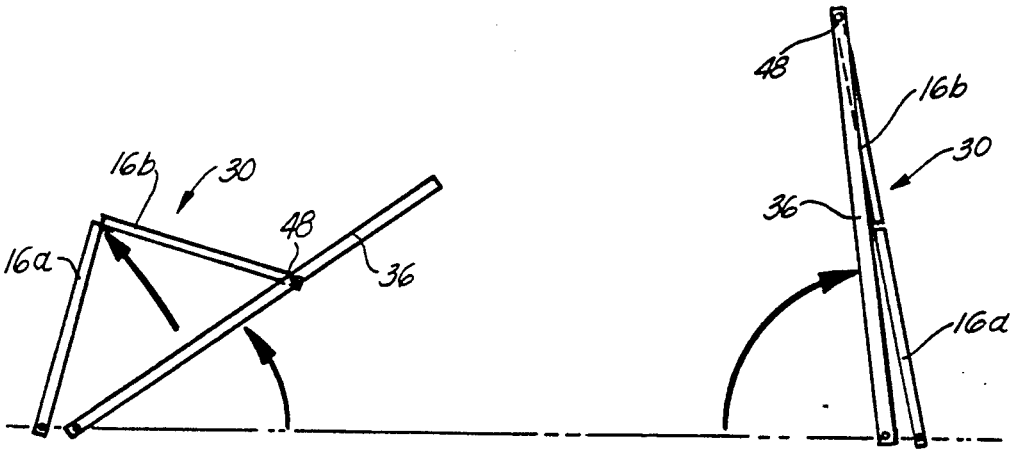
Figure 4:
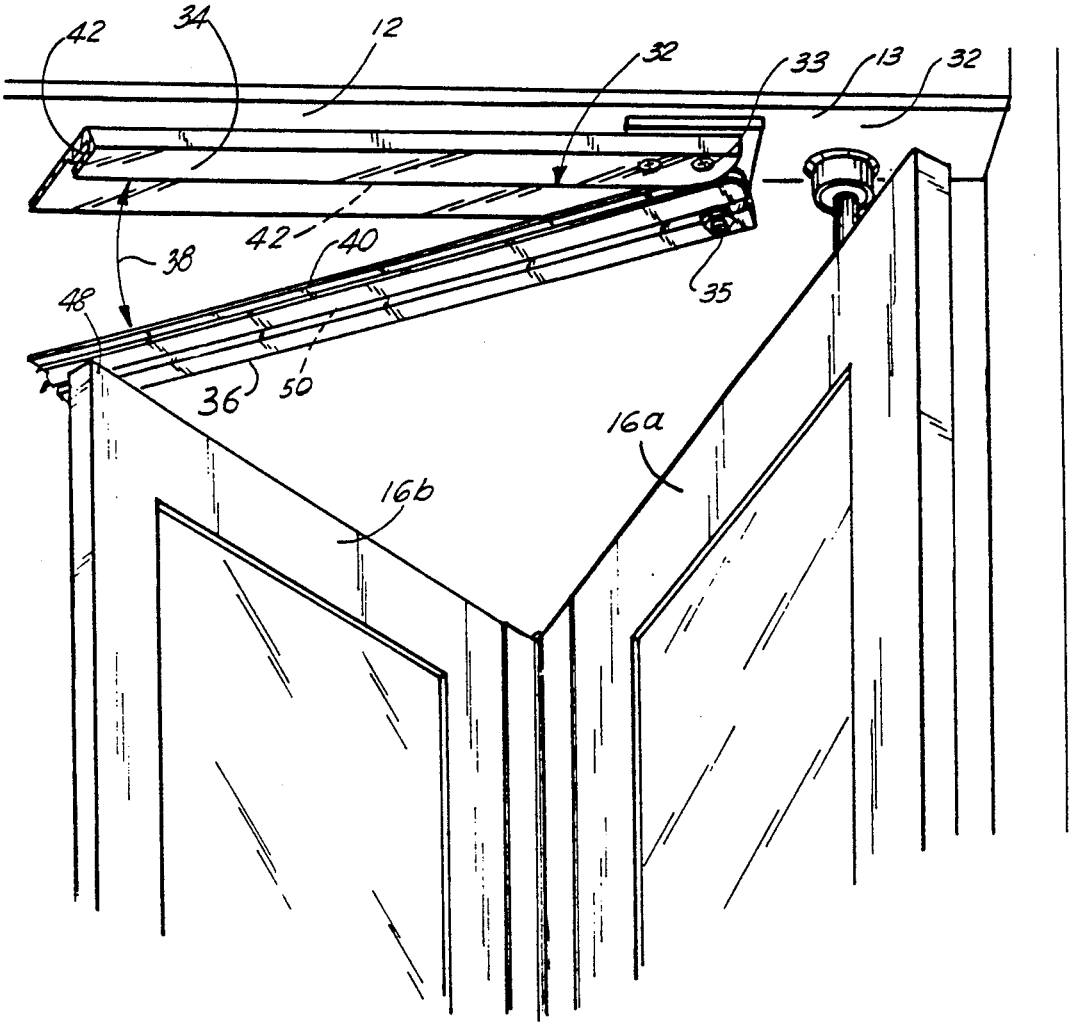
FIG. 4 illustrates an isolated view of the stationary and movable plate assemblies utilized in break away bi-folding door of the present invention.

Turning now to FIGS. 3A through 6, reference is made to the assembly which in combination with the typical bi-folding doors as seen in FIGS. 1 and 2, present a novel approach to bi-folding doors. As illustrated in the FIGURES, there is provided a means 30 for allowing each of the sets of panels 16*a* and 16*b* to swing open as would a standard door, when the need arises. This means 30 comprises an arm assembly 32, as seen in FIG. 4, secured through bolting 33 or the like to the under surface 13 of frame 12, the arm assembly 32 comprising a stationary plate 34 secured along the length of the frame directly above the pair of doors 16*a* and 16*b*. The arm assembly 32 would also include a hinged plate 36, hinged to frame 12 by pin member 35 which allows plate 36 to swing from a first position where the hinged plate 36 is engaged along its length to the stationary plate 34. As seen in FIG. 4, stationary plate 34, is bolted to frame 12 as illustrated, with hinged plate 36 being swung to the open or closed positions, in the direction of arrow 38. When engaging one another, hinged plate 36 is provided with a tongue member 40 substantially along its length. As seen, tongue member 40 would slidingly engage into a groove 42, formed within the stationary plate 34, so that when the two plates are matingly engaged along their length, the plates define a continuous door frame as illustrated.

Figure 2A:
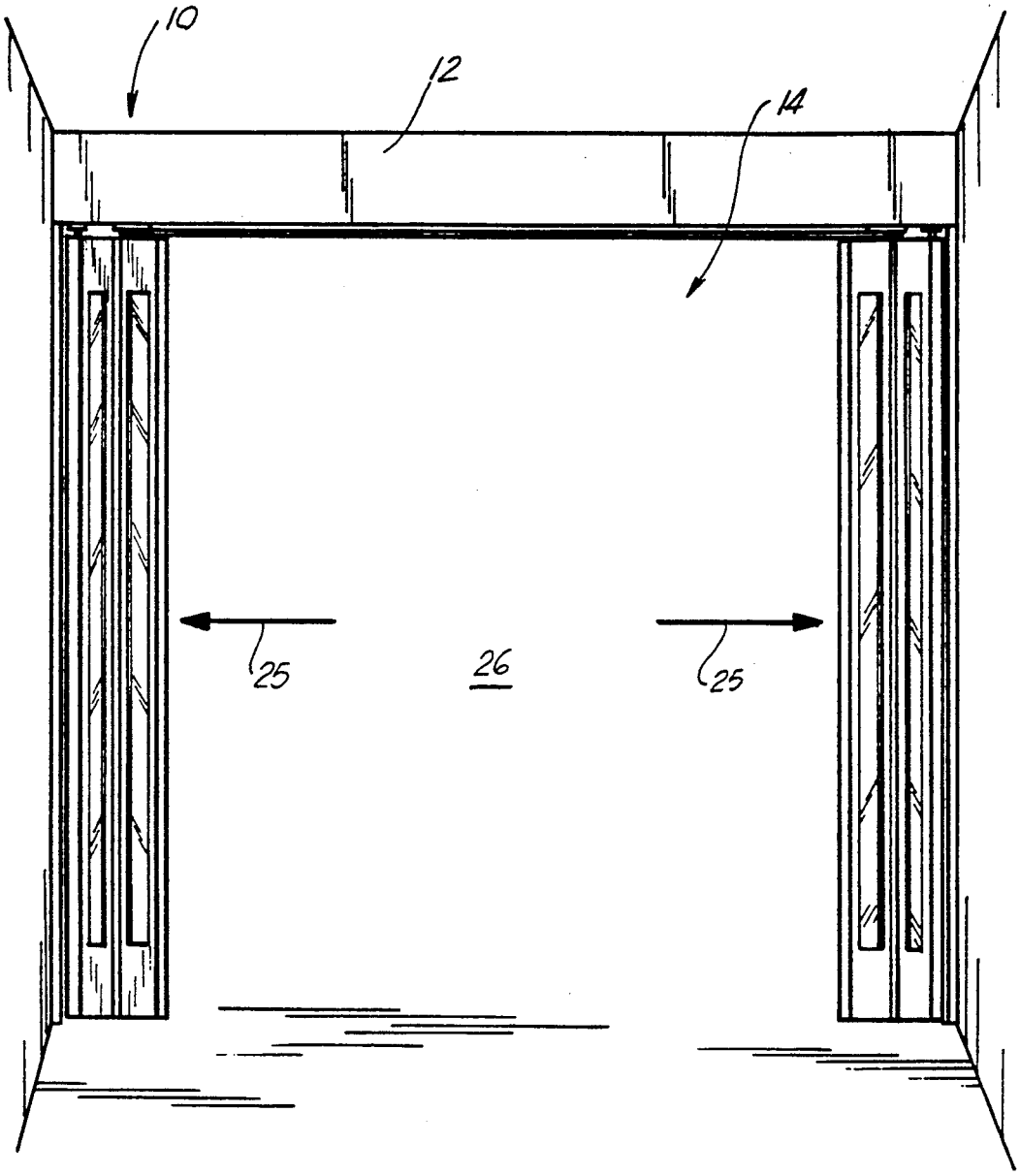
FIGS. 2A and 2B illustrate front and top views of the bi-folding door assembly in the fully open position.
Figure 2B:
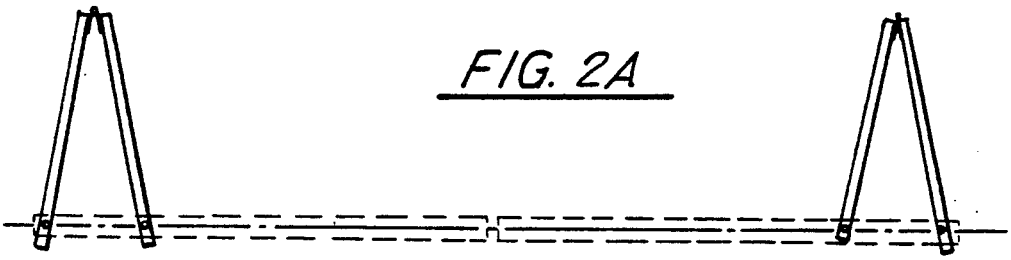
Figure 6:
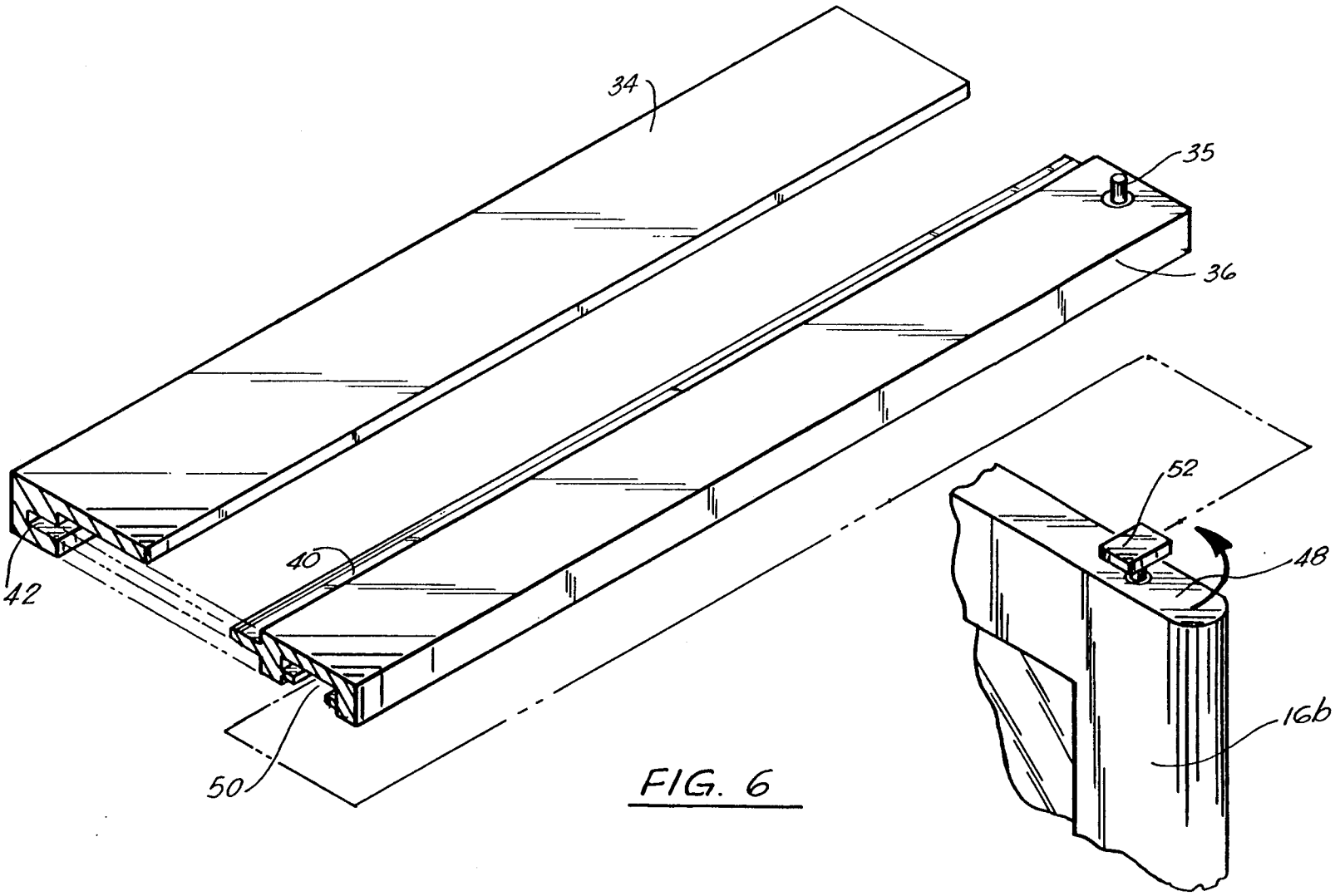
FIG. 6 illustrates an isolated perspective view of the inner locking feature of the movable and stationary plate assemblies of the present invention.

The function of the hinged plate 36, as illustrated, provides a means to allow the bi-folding doors, 16*a*, 16*b*, to open in a second manner other than by bi-folding. As stated earlier, FIG. 2A illustrates the typical bi-folding doors, as they would normally fold back to the open position. This means of opening would still be provided with the present invention, when the hinged plate 36 is engaged along its length to the stationary plate 34. However, in the event, the bi-folding doors must be opened as would a normal door, reference is first made to FIG. 3B, where the hinged plate 36, has been swung to disengage from the stationary plate 34, and the bi-folding door panels 16*a*, 16*b*, are likewise swinging back, with the plate 36. This is accomplished because the travelling end 48 of each of the bi-folding doors panels 16*b* are pinned within a continuous slot 50 within the hinged plate 36, as seen in FIG. 4. Therefore, as the hinged plate 36 is moved out of engagement, the bi-folding door panels 16*a*, 16*b*, likewise travel away from their normal travelling position, and move outward with the movement of the hinged plate 36. Therefore, as seen in FIG. 3B, the bi-folding doors, when swung outward with plate 36, are allowed to pivot, and slide within slot 50, so as to be moved to the fully open position, as seen in FIG. 3B, thus providing a greater opening in the doorway. A travelling member 52 is engaged into slot 50, as seen in FIG. 6, to provide for the travelling end 48 of panel 16*b* to travel during operation.

Figure 5:
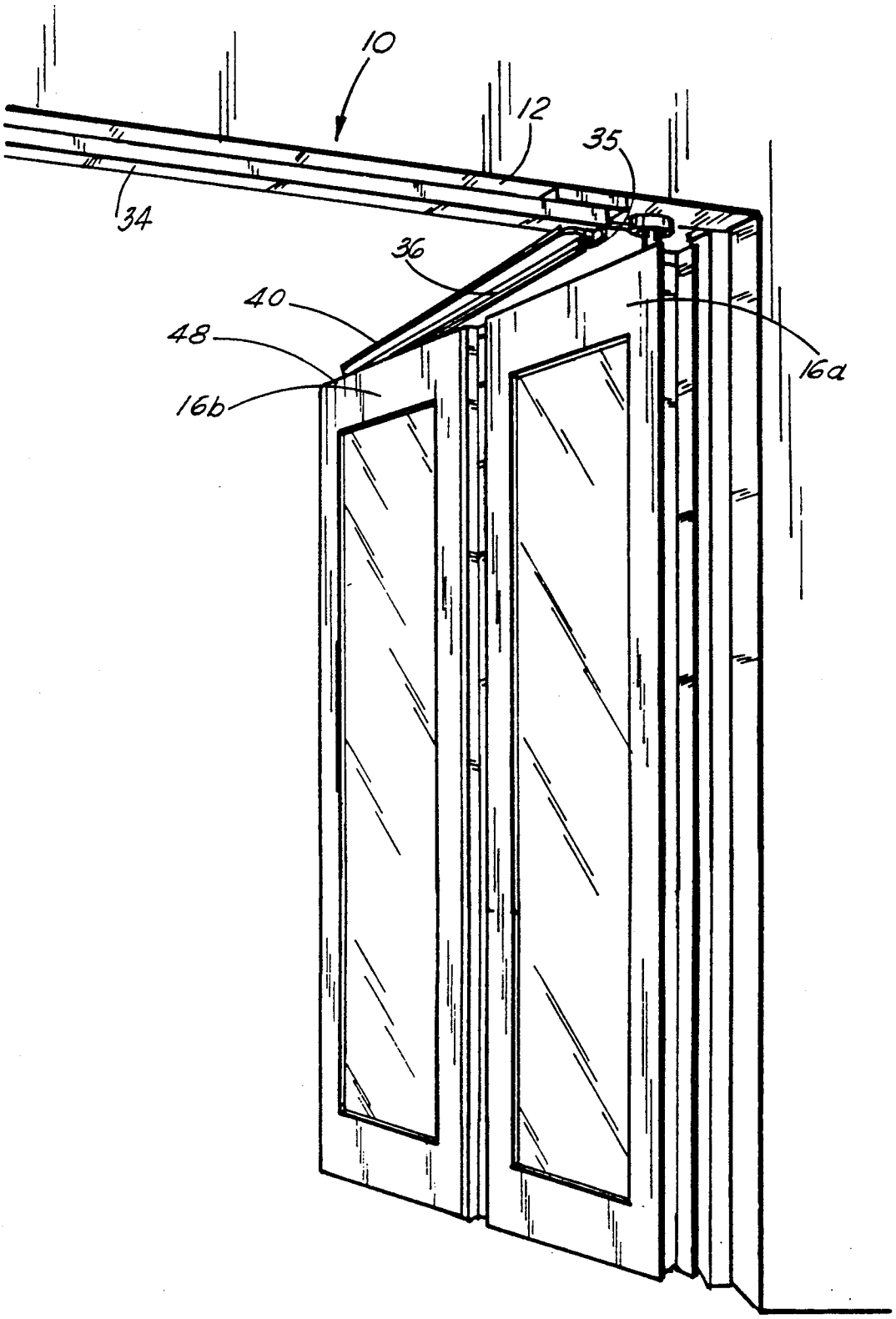
FIG. 5 illustrates the break away bi-folding door assembly of present invention in the fully opened position as with a conventional door.

Furthermore, FIG. 5 shows clearly the bi-folding door panels 16*a* and 16*b* in the fully open position, with hinged plate 36 swung fully open, and the travelling end 48 of bi-folding door panel 16*b* extending fully outward to the end of slot 50, to allow it to be fully opened. It should be made fully clear that the bi-folding door panels 16*a*, 16*b*, because of the unique arrangement in sliding engagement with the hinged plate 36, may be moved from the normal bi-folding operation to the conventional swinging door operation, at any time during their travels within slot 50. As is seen, this is accomplished simply because the bi-folding door is engaged into the hinged plate 36, and by being engaged thusly, when the plate 36 is swung open, the travelling end 48 of door panel 16*b* likewise travels with the hinged plate 36.

In the construction of the novel arrangement as discussed, the doors may be operated either manually, or through powered means. Typically, when used in a hospital the bi-folding operation is powered and activated by an electric eye. However, during an emergency, a person may simply apply force to the travelling end of the closed doors 16*a*, 16*b*, and such force would disengage the hinged plate 36 from the stationary plate 34, and the doors would swing open to the position as seen in FIG. 5. Likewise, it would not be necessary in all cases to open both doors, but simply swing open a single door assembly 16, so as to provide ingress and egress therethrough.

Part List

Breakaway bi-folding door apparatus 10
upper frame means 12
doorway 14
door panels 16
two pairs 18, 20
pair of panels 16*a*, 16*b*
edges 21
continuous connection 22
pins 24
opening 26
means 30
arm assembly 32
under surface 13
stationary plate 34
pin member 35
hinged plate 36
arrow 38
tongue member 40
groove 42
travelling end 48
continuous slot 50

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A breakaway bi-folding door assembly, comprising:

a) at least one set of bi-folding doors, of the type having a first end hinged to a frame, and a second end travelling within a slot in the frame to allow the doors to fold and unfold between open and closed positions;

b) a moveable plate member having a first end and a second end, the movable plate member being positioned on the frame and hinged along the first end for moving outward from the frame;

c) a slot cut within the moveable plate member, for engaging the travelling end of the bi-folding door; and d) means on the moveable plate member for allowing the moveable plate member to be disengaged from the frame and moved to an open position where the second end of the moveable plate member is spaced from the frame, and defining a track for allowing the bi-folding door to likewise be swung to the fully open position, wherein the first end of the set of bi-folding doors is adjacent the first end of the moveable plate member.

2. The assembly in claim 1, further comprising a second bi-folding door assembly to define a pair of bi-folding doors in a passageway.

3. A breakaway bi-folding door assembly, comprising:

a) at least one set of bi-folding doors, of the type having a first end hinged to a frame, and a second end travelling within a slot in the frame to allow the doors to fold and unfold between open and closed positions;

b) a moveable plate member, positioned on the frame, and hinged along one end for moving outward from the frame;

c) a slot cut within the moveable plate member, for engaging the travelling end of the bi-folding door; and d) means on the moveable plate member for allowing the moveable plate member to be disengaged from the frame and moved to an open position, and defining a track for allowing the bi-folding door to likewise be swung to the fully open position; and e) a stationary plate member secured to the frame, to define the means to engage and disengage the moveable plate member as the moveable plate member swings between open and closed positions.

4. The assembly in claim 3, wherein the moveable plate member is engaged into the stationary plate member via a tongue and groove mating means.

5. The assembly in claim 3, wherein the moveable plate member may be disengaged from the stationary plate member through a manual force to the travelling end of the bi-folding door assembly.

6. The assembly in claim 1, wherein the moveable plate member may be moved from the engaged to the disengaged position at any time during the travelling position of the bi-folding door.

7. The assembly in claim 1, wherein the assembly defines a means to provide a greater opening through a passageway than is normally provided by bi-folding doors.

8. The assembly in claim 1, wherein the assembly further defines a means to allow bi-folding doors to be maneuvered in the manner of a conventional hinged door during emergency situations.

9. A breakaway bi-folding door assembly, comprising:

a) a pair of bi-folding doors, of the type having a first end hinged to a frame, and a second end travelling within a slot in the frame to allow the doors to fold and unfold between open and closed positions, for defining an open or closed doorway through a passage such as a hallway;

b) a moveable plate member for each bi-folding door, positioned on the frame, and hinged along one end for moving outward from the frame;

c) a slot cut within the moveable plate member, for engaging the travelling end of each of the bi-folding doors; and d) a stationary plate, positioned on the frame, for defining a means to engage the moveable plate members when the doors are operated as standard bi-folding doors and for further allowing the moveable plate members to be disengaged from the frame and moved to the open position, allowing the bi-folding doors to likewise be swung to the fully open position.

10. The assembly in claim 9, wherein the stationary plate defines the means to engage and disengage the moveable plate members as the moveable plate members swing between open and closed positions.

11. The assembly in claim 9, wherein the moveable plate members are engaged into the stationary plate via a tongue and groove mating means.

12. The assembly in claim 9, wherein the moveable plate members may be disengaged from the stationary plate through a manual force to the travelling end of the bi-folding door assemblies.

13. The assembly in claim 9, wherein the moveable plate members may be moved from the engaged to the disengaged position at any time during the travelling position of the bi-folding door.

14. The assembly in claim 9, wherein the assembly defines a means to provide a greater opening through a passageway than is normally provided by bi-folding doors.

15. The assembly in claim 9, wherein the assembly further defines a means to allow bi-folding doors to be maneuvered in the manner of a conventional hinged door during emergency situations.

* * * * *